US005176377A

United States Patent [19]

Wilkinson

[11] Patent Number: 5,176,377

[45] Date of Patent: Jan. 5, 1993

[54] COORDINATED ARM-LEG AEROBIC WALKING EXERCISE DEVICE

[76] Inventor: William T. Wilkinson, P.O. Box 572, Crownsville, Md. 21032

[21] Appl. No.: 659,491

[22] Filed: Feb. 19, 1991

[51] Int. Cl.[5] ..... A63B 69/00

[52] U.S. Cl. ..... 482/120; 482/114; 482/124; 482/125

[58] Field of Search ..... 272/137, 119, 126, 70, 272/70.3, 139; 128/25 R

[56] References Cited

U.S. PATENT DOCUMENTS

| | | | |
|---|---|---|---|
| 420,178 | 1/1890 | Yagn | 272/70 |
| 1,402,179 | 1/1922 | Piscitelli | 272/139 |
| 2,097,376 | 10/1937 | Marshman | 272/139 |
| 2,613,932 | 10/1952 | Manners | 272/139 |
| 3,162,441 | 2/1965 | Karlik | 272/139 |
| 4,685,671 | 8/1987 | Hagerman | 272/139 |
| 4,872,665 | 10/1989 | Chareire | 272/70 |
| 4,955,608 | 9/1940 | Dougherty | 272/137 |
| 4,961,573 | 10/1990 | Wehrell | 272/139 |

*Primary Examiner*—Robert Bahr
*Assistant Examiner*—Jerome Donnelly
*Attorney, Agent, or Firm*—Charles S. Knothe

[57] ABSTRACT

An exercise device for enhanced aerobic walking that coordinates the motion of the arms and legs. The device is worn around the torso by means of a belt mounted yoke which has an extension pole extending downwardly and rearwardly. Both the length of the extension pole and the angle of the extension pole to the yoke can be adjusted. Exercise cords are threaded through guides and brake-lock devices located on the sides of the yoke and a guide loop at the end of the extension pole. At each end of the exercise cord are cuffs, which are attached to the exerciser's extremities. Several threading methods are available for coordinated exercise: left arm to right leg and right arm to left leg; left arm to left leg and right arm to right leg; the left and right arm; and the left and right leg. The brakes can be used to increase the resistance and the locks can be used to fix the exercise cord in a position and use the elasticity of the cord for maximum resistance.

16 Claims, 9 Drawing Sheets

COORDINATED ARM-LEG AEROBIC WALKING EXERCISE DEVICE

BACKGROUND OF INVENTION

America has become concerned with fitness. Medical personnel recommend exercise as part of proper living for a longer, healthier life. Running was a favored form of cardio-vascular exercise but many people received injuries to their feet, ankles, knees, hips and other parts of their skeletal system. Because of these injuries walking has now become the favored exercise. Walking is a much lower impact exercise and the exerciser does not receive the injuries that running can cause. But for the same effect as running walking takes much more time. Therefore, many exercisers have turned to walking with some type of load factor such as ankle weight, vest, dumbbells, etc.

This invention is for the exerciser who wants to do enhanced aerobic walking by adding resistance to his walking to exercise his legs and at the same time exercise his arms. With this invention the exerciser can enhance the benefits of walking without the injurious impact to the skeletal system that running causes. One benefit is that more aerobic exercise is achieved in less time. Further, the exerciser can exercise his arms. Thus, at one time the exerciser can obtain total exercise of his body. The resistance force for both the arms and the legs can be adjusted to increase the resistance to build up the strength of the exerciser, (i.e. progressive exercise program) and adjustment allows for a universal device adaptable to all walkers.

Further, the device is designed so that the exerciser can use either the leg exerciser or the arm exerciser independently or both as the need be.

SUMMARY OF INVENTION

This invention discloses an aerobic walking exercise device with a belt with two ends with sufficient length to circumscribe the lower-torso of the exerciser and with a method of connecting the two ends of the belt such that the belt can be adjusted to varying sizes. A yoke with a semi-circular shape which conforms to the shape of the exerciser's lower torso is attached to the belt. The yoke can either be permanently attached to the belt or removably attached. A plurality of exercise cord guides are attached to the yoke. The exercise cord guide may contain a brake-lock device which restricts or stops the movement of the exercise cord through the brake-lock. Extending from the yoke is an extension pole. The length of the extension pole may be adjusted by use of telescoping poles and locking devices. Further, the angle of the extension pole to the yoke can be adjusted by means of a rotatable joint and locking device. A lower guide loop is attached to the end of the extension pole. Elastic exercise cords are threaded in various ways through the exercise cord guides and the lower guide loop. The length of each elastic cord is adjustable. The alternate arm-leg, same side arm-leg, arm to arm and leg to leg configurations can be established. At each end of the elastic cord is an adjustable cuff to attach the exercise cord to the exerciser's wrists or arms and legs, feet, shoes, or ankles.

DETAILED DESCRIPTION OF THE DRAWINGS

Figure 1:
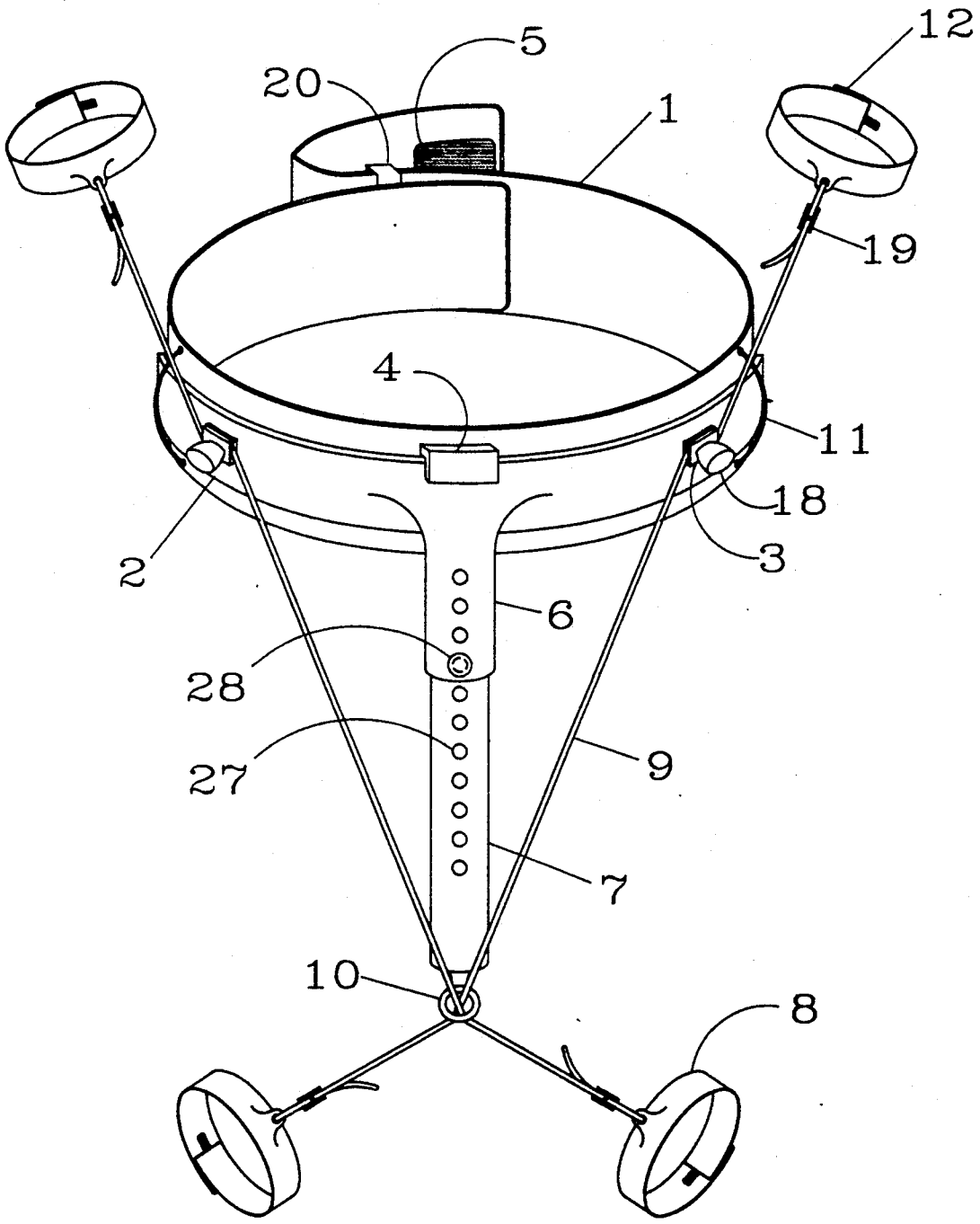
FIG. 1 is a perspective front view of the exercise device with two elastic cords; the left upper cuff threaded to the right lower cuff and right upper cuff threaded to left lower cuff.

FIG. 1 shows the belt 1 that attaches around the exerciser's torso. The belt is adjustable in length so that it can accommodate individuals with different size waists. The preferred method of adjusting the length of the belt 1 is by means of a belt loop 20 which is attached to one end of the belt 1 and the other end of the belt 1 passes through the loop 20 and the belt folds back upon itself and is attached to itself by means of a hook and loop fastener 5. The hoop and loop fastener 5 allows a great degree of adjustment. Other means of attachment could also be used such as a belt with holes and a buckle. The inner surface of the belt can be padded with a cushioning material to reduce any possible discomfort due to pressure and chaffing during use. In the preferred embodiment the yoke 2 is removably attached at three locations to the belt 1 by means of the yoke receiving loops 11 attached on opposite sides of the belt 1 and the yoke mounting clasp 4. Alternatively, the yoke 2 can be permanently affixed to the belt 1 but the removable yoke allows for easier storage and installation of the device.

FIG. 1 depicts the extension pole 6 molded to the yoke 2. In the preferred embodiment the extension pole consists of two segments; an upper portion 6 and a lower portion 7. The lower portion 7 telescopes within the upper portion 6 and both portions contain adjustment holes 27 into which a locking pin 28 is inserted. This allows the length of the extension pole to be adjusted to accommodate the various heights of the exerciser and threading configurations.

FIG. 1 shows the upper cuff 12 which can be worn by the exerciser around his wrist, hand or arm. The upper cuff 12 is attached to the end of the exercise cord 9 and a buckle or clamp device 19 is used to adjust the length of the exercise cord 19. The exercise cord may be made from elastic material or non-elastic material. The exercise cord 19 is threaded through the exercise cord guide 3 and then through the lower guide loop 10. The lower extremity cuff 8 is attached to the other end of the elastic cord 9. Both the upper extremity cuffs 12 and the lower cuffs 8 are coupled together by means of hook and loop fasteners and can have padding material on the inner surface. In FIG. 1 the exerciser's the right upper extremity would be coordinated with the left lower extremity with one exercise cord and the left upper extremity would be coordinated with the right lower extremity with another exercise cord. As exerciser moves his lower extremity forward the alternate upper extremity is pulled rearward. As the upper extremity is pulled forward the alternative lower extremity is pulled rearward. This results in an alternating cadence between the upper and lower extremities as the exerciser walks.

The exercise cord 9 passes through the brake-locks 18 as shown in FIG. 1. The brake-lock adds resistance to the transversing of the exercise cord. If the exercise cord is constructed from elastic material and the brake is locked the exerciser can work against the resistance from the exercise cord for both the upper and lower extremities. The upper and lower cuffs are removable from the exercise cord. Different strength exercise cords can be used to create a progressive exercise program.

Figure 2:
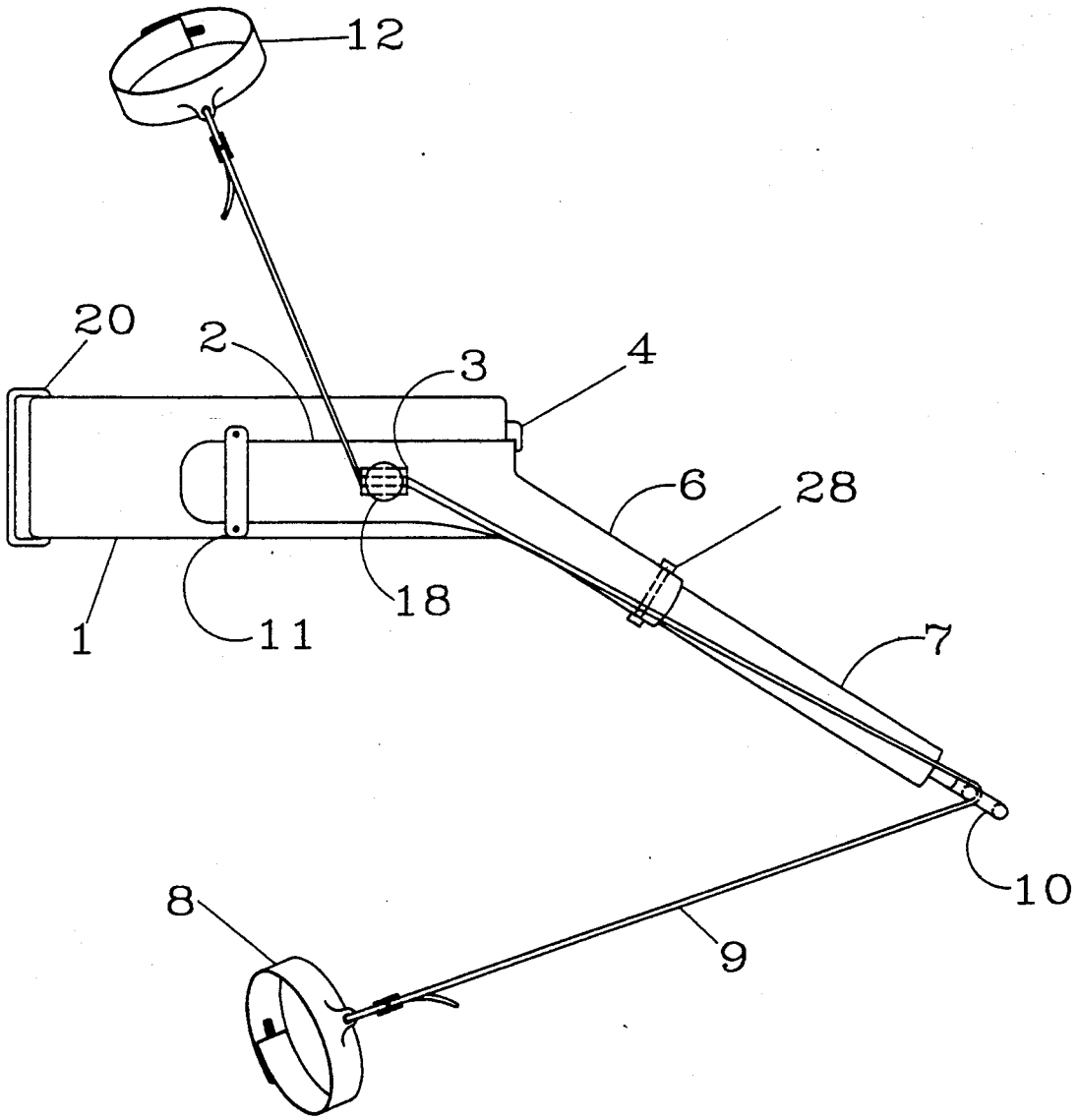
FIG. 2 is a side view of the device showing the extension pole.

FIG. 2 is a side view of the device. This view shows the extension pole 6 extending downward and outward from the belt 1. The extension pole must extend out far enough from the exerciser's body so that it does not interfere with the exerciser's legs and feet while walking. The length of the extension pole can be adjusted by extending or collapsing the telescoping lower extension pole 7. This adjustment is necessary to accommodate various height individuals and the different locations the lower extremity cuff can be attached to the exerciser. The exerciser can attach the lower cuff to the ankle, leg or thigh. Each location results in a different leverage and requires a different length of the extension pole.

FIG. 2 shows the removable yoke embodiment. Here the yoke receiving loop 11 are mounted to the sides of the belt 1, one on each side of the belt 1. The yoke mount clasp 4 securely attaches and locks the yoke 2 to the belt 1.

FIG. 2 shows the upper cuff 12 attached to the exercise cord 9 and the exercise cord 9 threaded through the exercise cord guide 3, the brake-lock device 18 and through the lower guide loop 10 and connected to the lower cuff 8. Thus when the upper cuff is moved forward it pulls the lower cuff rearward.

Figure 3:
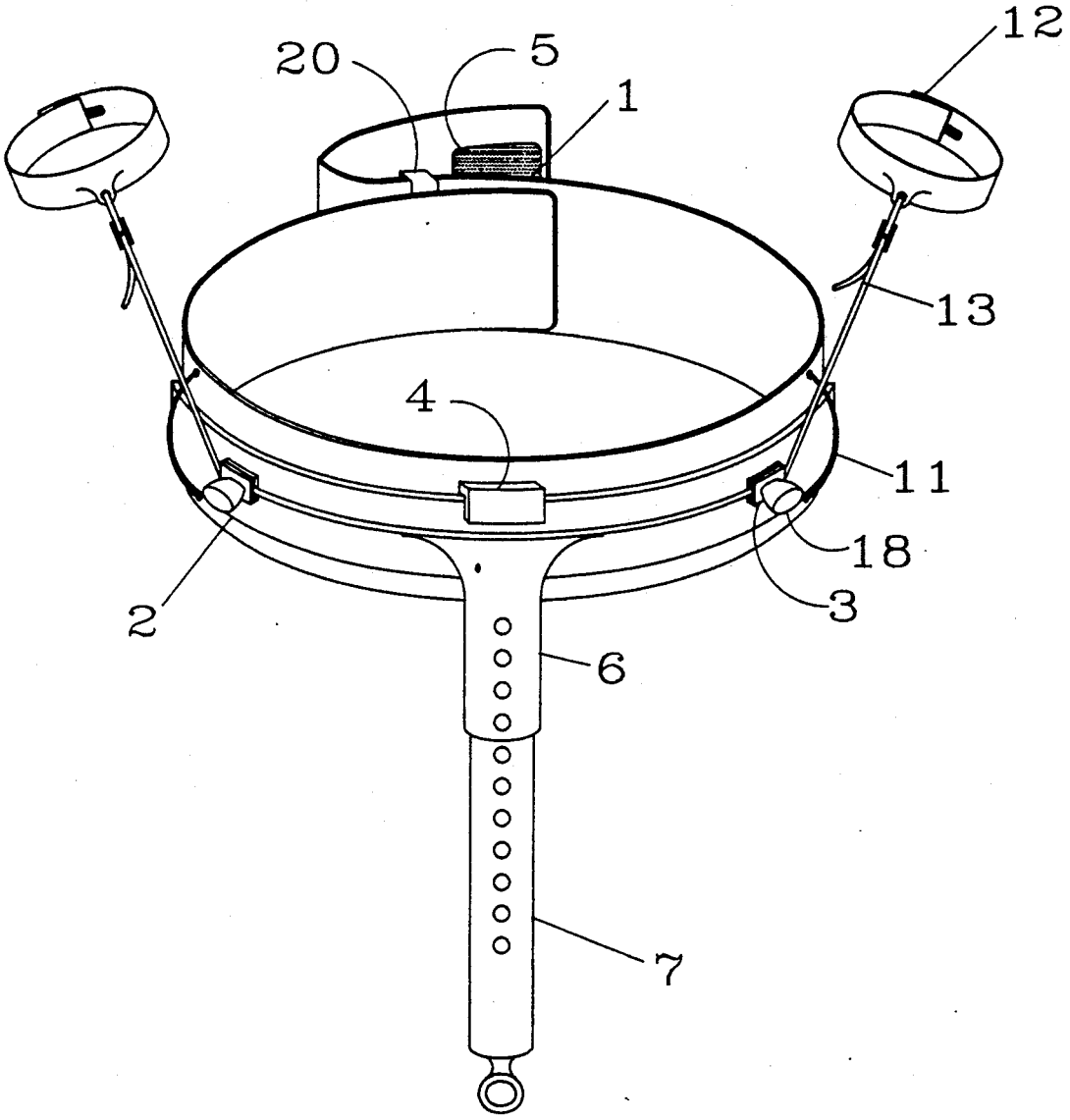
FIG. 3 is a front perspective view of the device with the exercise cord threaded with the left upper cuff to the right upper cuff.

FIG. 3 depicts that same belt 1 and yoke 2 but the exercise cord is threaded from the left upper cuff 12 through the left exercise cord guide 3, the left brake-lock 18 to the the right brake-lock 18, the right exercise cord guide 3 to the right upper cuff 12. With this threading method the exerciser can obtain a push-pull cadence with his arms. The brake-lock can be used to adjust the resistance or to the lock the exercise cords and use the elastic ability of the exercise cords alone.

Figure 4:
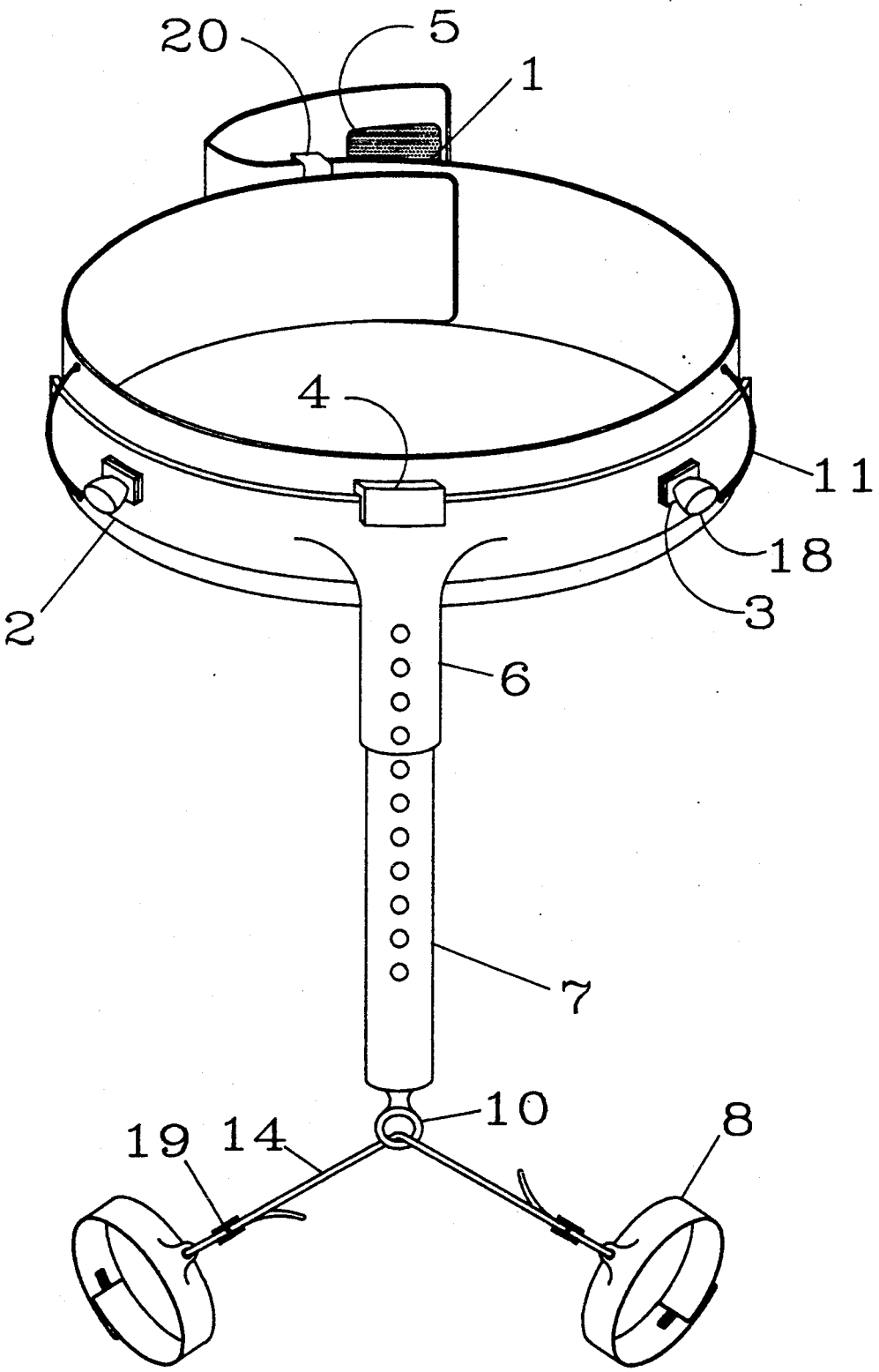
FIG. 4 is a front perspective view of the device with the exercise cord threaded with the left lower cuff to the right lower cuff.

FIG. 4 shows another alternate threading method whereby the exercise cord 14 is threaded from the left lower cuff 8 through the lower guide loop 10 to the right lower cuff 8. With this threading method the exerciser can obtain a push-pull cadence with his legs.

Figure 5:
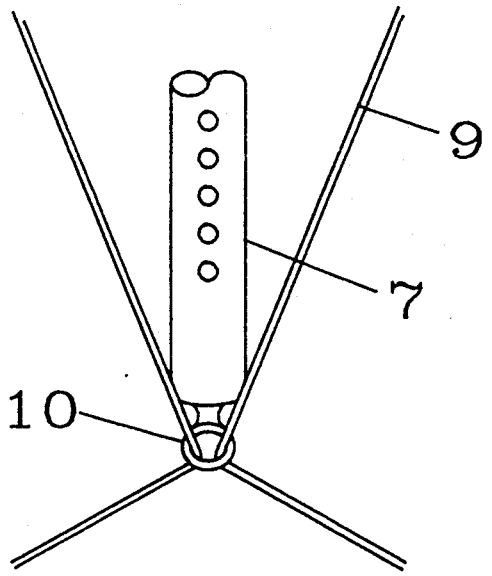
FIG. 5 is a fragmentary view of the lower guide loop with the exercise cord threaded with the left upper cuff connected to the right lower cuff and the exercise cord threaded from the right upper cuff to the left lower cuff.
Figure 6:
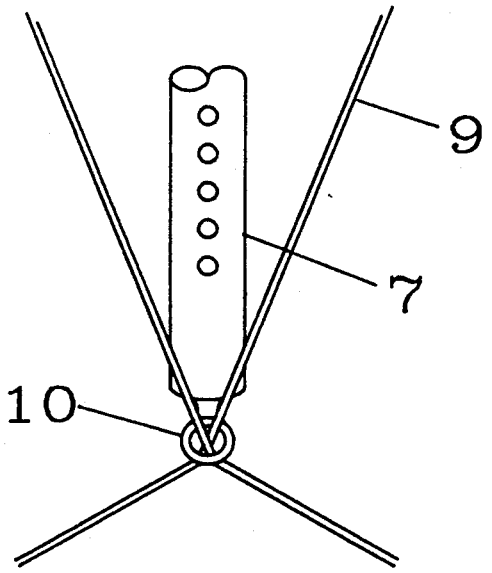
FIG. 6 is a fragmentary view of the lower guide loop with the exercise cord threaded with the left upper cuff to the left lower cuff and the exercise cord from the right upper cuff threaded to the right lower cuff.

FIG. 5 and 6 show the exercise cord 9 passing through the lower guide loop 10. In FIG. 5 the device is threaded such that same side upper and lower extremity coordination is obtained. In FIG. 6 the device is threaded such that opposite upper and lower extremity coordination is obtained. This is the preferred embodiment of this invention.

Figure 7:
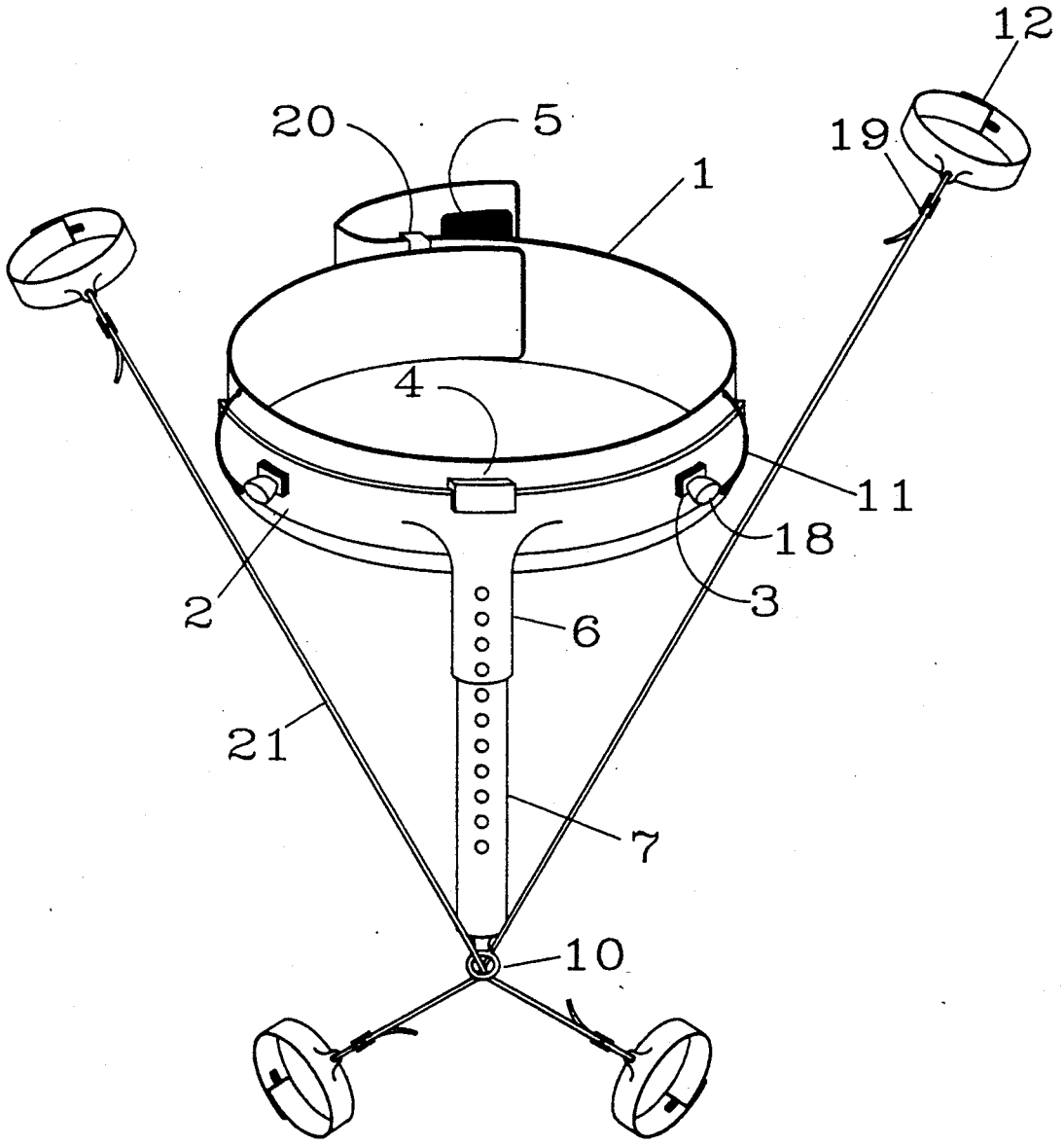
FIG. 7 is a perspective view of the device with the exercise cord connected to the upper cuffs and passing through the lower guide loop to the lower cuffs.

FIG. 7 shows still another alternate threading method wherein the exercise cord 21 is connected to the upper left cuff and threaded through the lower guide loop 10 and connected to the lower right cuff 8. Another exercise cord 21 is connected to the upper right cuff and threaded through the lower guide loop 10 and connected to the lower left cuff 8.

Figure 8:
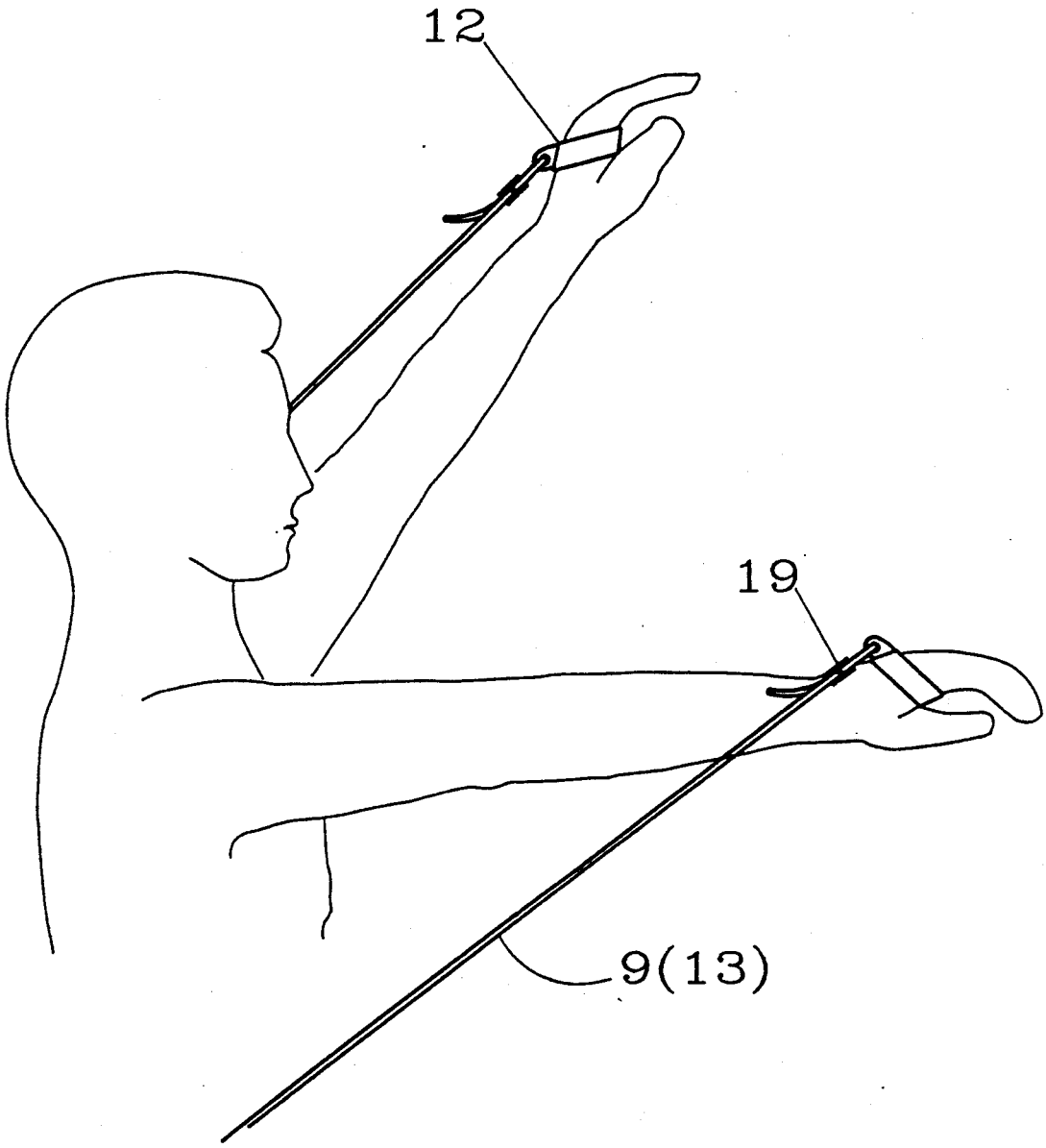
FIG. 8 shows the upper cuffs looped over the hand.

FIG. 8 shows an exerciser using the device with the upper cuffs 12 looped over his hands.

Figure 9:
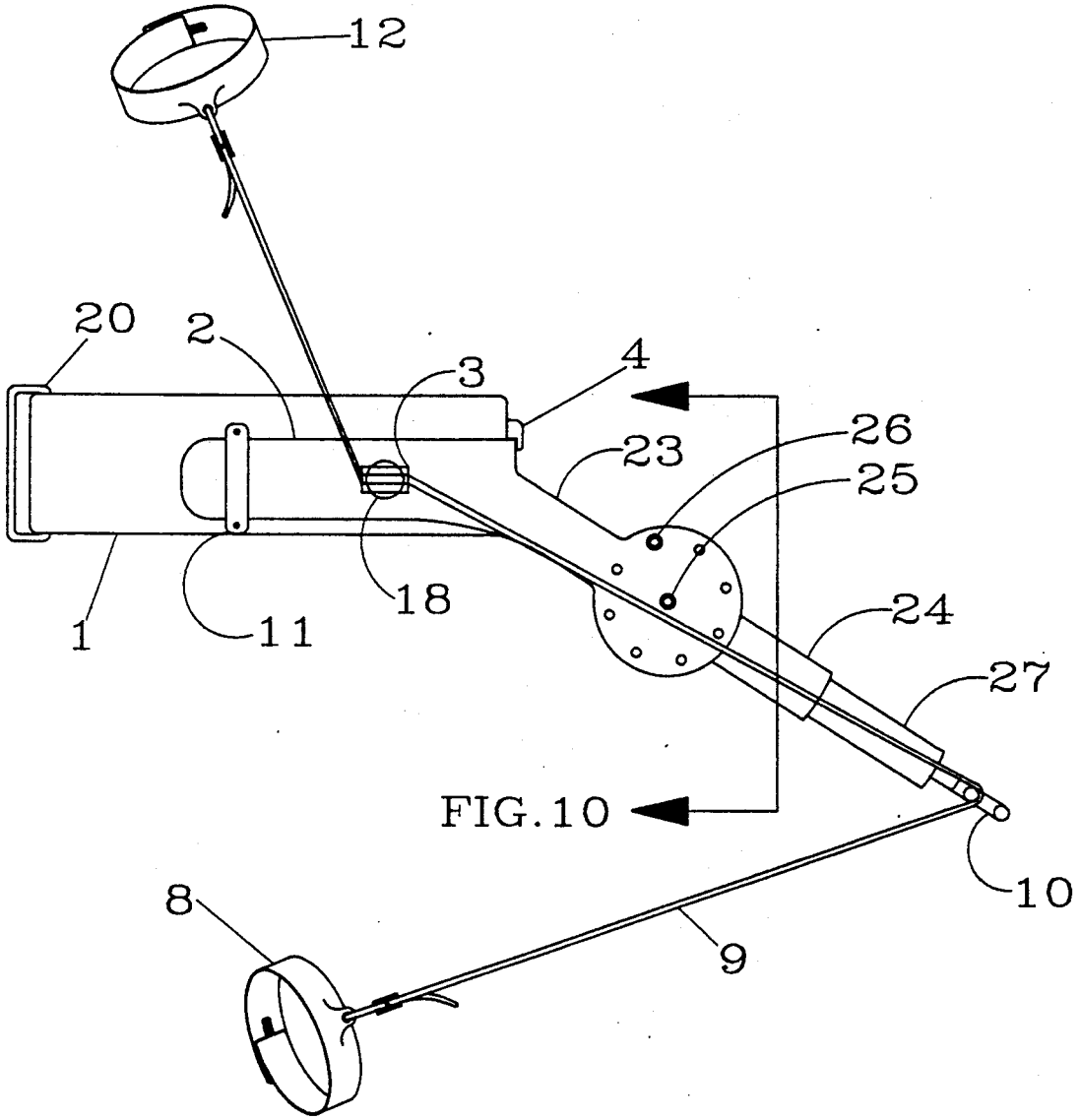
FIG. 9 is a side view of the device with the extension pole angular adjusting means.
Figure 10:
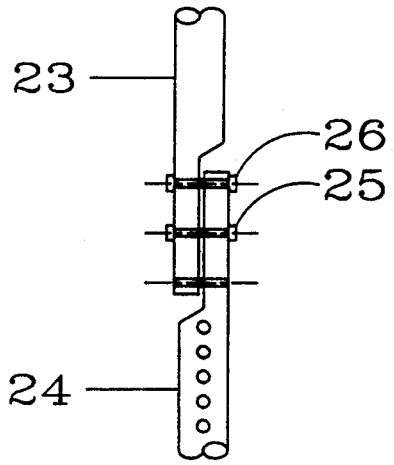
FIG. 10 is a sectional view of the angle adjusting means along the section line 10 in FIG. 9.

FIGS. 9 and 10 depict a means for adjusting the angle between the yoke 2 and the extension pole 23. At the lower end of the upper extension pole 23 is a circular plate containing holes along the perimeter and a hole in the center. Coordinating with this circular plate in a similar circulator plate on the upper end of the lower extension pole 24. The two circular plates are rotatably connected by fastener 25 and the angular position is determined by locking pin 26.

Figure 11:
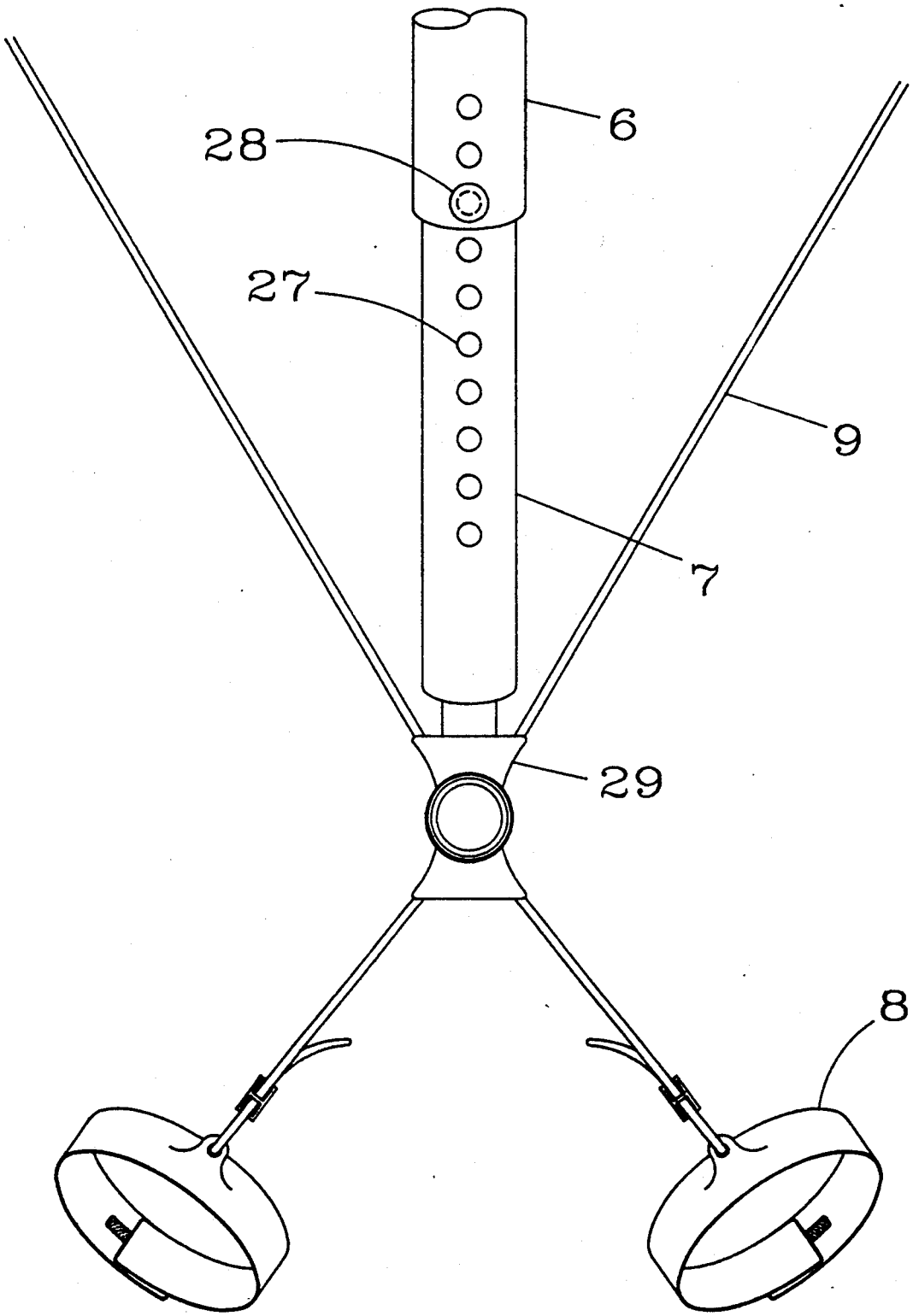
FIG. 11 is a fragmentary view of the lower guide with a brake-lock device.

FIG. 11 shows the a brake-lock device 29 attached to the lower end of the extension pole 7. The exercise cords 9 pass through the brake-lock device 29 which restrict the travel of the exercise cords or lock the exercise cords in a fixed position.

I claim:

1. An aerobic walking exercise device comprising:

a belt with two ends with sufficient length to circumscribe the lower-torso of the exerciser;

a means for connecting the two ends of the belt such that the belt can be adjusted to varying sizes;

a rigid yoke with a semi-circular shape that conforms to the shape of the exerciser's lower torso which is attached to the belt;

a plurality of exercise cord guides attached to the yoke;

a rigid extension pole rigidly attached to the yoke and extending downwardly and outwardly from the yoke;

a lower guide loop with a smooth inner surface mounted at the end of the extension pole;

a plurality of exercise cords threaded through the exercise cord guides, and the lower guide loop;

an upper cuff affixed to one end of the exercise cord and a lower cuff attached to the other end of the exercise cord;

a means for adjusting the length of the exercise cord;

each cuff having a means of adjusting to various lengths.

2. The same device as claimed in claim 1 wherein the extension pole is a plurality of telescoping poles with a plurality of locking devices such that the length of the pole is adjustable.

3. The same device as claimed in claim 1 wherein the exercise cord guide contains a brake device to increase the effort necessary for the exercise cord to pass through the exercise cord guide.

4. The same device as claimed in claim 1 wherein the exercise cord guide contains a locking device to fix the position of the exercise cord in the exercise cord guide.

5. The same device as claimed in claim 1 wherein the the angle of the extension pole to the belt is adjustable by means of a rotatable joint and locking device.

6. The same device as claimed in claim 1 wherein the lower loop guide contains a brake device to increase the effort necessary for the exercise cord to pass through the lower loop guide.

7. The same device as claimed in claim 1 wherein the lower loop guide contains a locking device to fix the position of the exercise cord in the lower loop guide.

8. The same device as in claim 1 wherein the exercise cords are a series of exercise cords with a progressive modulus of elasticity to vary the resistance.

9. The same device as claimed in claim 1 wherein said plurality of exercise cord guides include a left and a right cord guide mounted on the left hand side and right hand side of the yoke, respectively.

10. The same device as claimed in claim 9 wherein the device further includes a second upper cuff and a second lower cuff.

11. The same device as claimed in claim 10 wherein one exercise cord is attached to the first upper cuff and is threaded through the exercise cord guide mounted on the left hand side of the yoke, through the lower guide loop to the second lower cuff and another exercise cord is attached to the second upper cuff and is threaded to the exercise cord guide mounted on the right hand side of the yoke and through the lower guide loop to the first lower cuff.

12. The same device as claimed in claim 10 wherein one exercise cord is attached to the first upper cuff and is threaded through the exercise cord guide mounted on the left hand side of the yoke, through the lower guide loop to the first lower cuff and another exercise cord is attached to the second upper cuff and is threaded through the exercise cord guide mounted on the right hand side of the yoke and through the lower guide loop to the second lower cuff.

13. The same device as claimed in claim 10 wherein one exercise cord is attached to the first upper cuff and is threaded through the exercise cord guide mounted on the left hand side of the yoke, through the exercise cord guide mount on the right hand side of the yoke and attached to the second upper cuff.

14. The same device as claimed in claim 10 wherein an exercise cord is attached to the first lower cuff and threaded through the lower guide loop and attached to the second lower cuff.

15. The same device as claimed in claim 10 wherein one exercise cord is attached to the first upper cuff and threaded through the lower guide loop to the second lower-cuff and another exercise cord is attached to the second upper cuff and threaded through the lower guide loop to the first lower cuff.

16. The same device as claimed in claim 10 wherein one exercise cord is attached to the first upper cuff and threaded through the lower guide loop to the first lower cuff and another exercise cord is attached to the upper second upper cuff and is threaded through the lower guide loop to the second lower cuff.

* * * * *